US006238265B1

(12) United States Patent
Crane et al.

(10) Patent No.: US 6,238,265 B1
(45) Date of Patent: May 29, 2001

(54) REMOTE CONTROL SYSTEM FOR OPERATING TOYS

(75) Inventors: John J. Crane, Ramona; William M. Barton, Jr., Encinitas; Paul Eichen, Rancho Santa Fe; Peter C. DeAngelis, Carlsbad; Robert T. Kulakowski, Leucadia, all of CA (US)

(73) Assignee: Rokenbok Toy Company, Encinitas, CA (US)

( * ) Notice: Subject to any disclaimer, the term of this patent is extended or adjusted under 35 U.S.C. 154(b) by 0 days.

(21) Appl. No.: 09/081,181

(22) Filed: May 19, 1998

Related U.S. Application Data

(62) Division of application No. 08/578,210, filed on Dec. 29, 1995, now Pat. No. 5,944,609.

(51) Int. Cl.[7] ..... A63H 30/04

(52) U.S. Cl. ..... 446/456; 463/5; 463/37; 273/454; 273/460

(58) Field of Search ..... 463/36, 37, 62, 463/63, 5; 273/317.1, 148 B, 454, 460; 340/323 R; 446/454, 456

(56) References Cited

U.S. PATENT DOCUMENTS 4,334,221 * 6/1982 Rosenhagen et al. ..... 340/825.72
4,709,265 * 11/1987 Silverman et al. ..... 358/108
4,938,483 * 7/1990 Yavetz ..... 273/311

* cited by examiner

*Primary Examiner*—Michael O'Neill
*Assistant Examiner*—Steven Ashburn
(74) *Attorney, Agent, or Firm*—Fulwider Patton; Ellsworth R. Roston

(57) ABSTRACT

When manually closed, switches in pads select toy vehicles and the operation of motors for moving the vehicles forwardly, rearwardly, leftwardly and rightwardly and moving upwardly and downwardly (and rightwardly and leftwardly) a receptacle for holding transportable elements (e.g. marbles). When sequentially and cyclically interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches addressing such vehicle. The signals for each vehicle are transmitted by wireless to all of the vehicles at a common carrier frequency modulated by the binary signals. The vehicle identified by the transmitted address demodulates the modulating signals and operates its motors in accordance with such demodulation. When the station fails to receive signals from a pad for a particular period of time, the vehicle addressed by such pad becomes available for addressing by any pad including the pad previously addressing the vehicle. A cable may couple two (2) central stations (one a master and the other a slave) to increase the number of pads controlling the vehicles. Stationary accessories (e.g. elevator) connected by wires to the central station become operative when addressed by the pads.

49 Claims, 4 Drawing Sheets

VCC
POWER UP RESET
122
VCC
130
12
TIME BASE FOR MICROCONTROLLER
XTAL
MICRO CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

REMOTE CONTROL SYSTEM FOR OPERATING TOYS

This is a division of application Ser. No. 08/578,210 filed on Dec. 29, 1995 (now U.S. Pat. No. 5,944,609).

This invention relates to a system for pleasurable use by people of all ages with youthful minds in operating remotely controlled vehicles simultaneously in a somewhat confined area. In the system of this invention, the vehicles can be remotely controlled to perform competitive or co-operative tasks. The system of this invention includes pads for operation by the users, vehicles remotely controlled in accordance with the operation of the pads and a central station for co-ordinating the operation of the pads and the vehicles. In addition to the inventive aspects of the system, each of the pads, the central station and the vehicles includes features of an inventive nature. The system of this invention also includes stationary plants (e.g. power plants and elevators) which are controlled by the operation of the pads. The invention additionally relates to methods including methods for controlling the operation of the vehicles on a remotely controlled basis.

BACKGROUND OF THE INVENTION

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are an automobile or an airplane. Furthermore, the functions of the remotely controlled unit, other than movement along a floor or along the ground or in the air, are quite limited.

Other types of play systems involve the use of blocks for building structures. These blocks often include structure for providing an interlocking relationship between abutting blocks. In this way, elaborate structures can be created by users with creative minds. However, such structures are generally built by hand.

Tests have indicated that there is a desirability, and even a need, for play systems in which vehicles are remotely operated to perform functions other than to move aimlessly along a floor or along the ground. For example, tests have indicated that there is a desirability, and even a need, for a play system in which the remotely controlled vehicles can transport elements such as blocks to construct creative structures. There is also a desirability, and even a need for play systems in which a plurality of vehicles can be remotely controlled by switches in hand-held pads to compete against one another in performing a first task or to co-operate in performing a second task such as building a miniature community through the transport of miniature blocks. Such a desirability, or even a need, has existed for a long period of time, probably decades, without a satisfactory resolution.

BRIEF DESCRIPTION OF THE INVENTION

This invention provides a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit providing a control of a different function in the individual one of the remotely controlled vehicles. Each of the remotely controlled vehicles in the system of this invention can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the invention, switches in pads control the selection of toy vehicles and the operation of motors for moving the vehicles forwardly, rearwardly to the left and to the right and moving upwardly and downwardly (and rightwardly and leftwardly) a receptacle for holding transportable elements (e.g. marbles).

When sequentially and cyclically interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) to increase the number of pads controlling by the vehicles. Stationary accessories (e.g. elevator) connected by wires to the central station become operative when selected by the pads.

Figure 1:
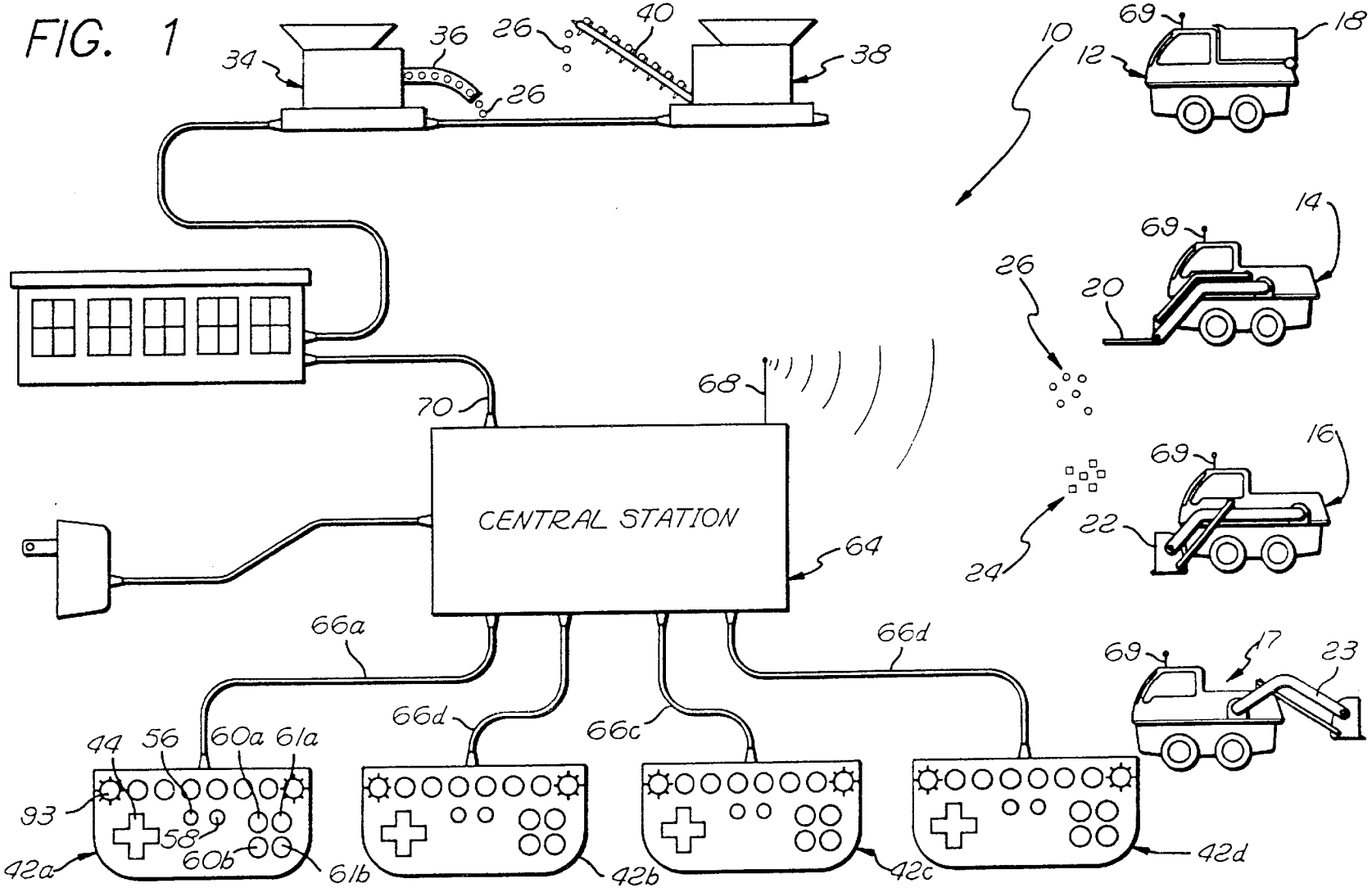
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17. For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the dump truck 12, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear wheels.

When the motors 28 and 30 are simultaneously operated in one direction, the dump truck 12 moves forwardly. The vehicle 12 moves rearwardly when the motors 28 and 30 are moved in the opposite direction. The vehicle 12 turns toward the right when the motor 30 is operated without simultaneous operation of the motor 28. The vehicle 12 turns toward the right when the motor 28 is operated without a simultaneous operation of the motor 30.

The vehicle 12 spins to the right when the motor 30 operates to move the vehicle forwardly at the same time that the motor 28 operates to move the vehicle rearwardly. The vehicle 12 spins to the left when the motors 28 30 are operated in directions opposite to the operations of the motors in spinning the vehicle to the right.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads may include a plurality of actuatable buttons. For example, each of the pads may include a 4-way button 44 in the shape of a cross. Each of the different segments in the button 42 is connected to an individual one of a plurality of switches 46, 48, 50 and 52 in FIG. 2.

When the button 44 is depressed at the segment at the top of the button, the switch 46 is closed to obtain the operation of the motor 28 (FIG. 4) in moving the selected one of the vehicle 12 forwardly. Similarly, when the segment at the bottom of the button 44 is depressed, the switch 48 is closed to obtain the operation of the motor 28 (FIG. 4) in moving the vehicle 12 rearwardly. The selective depression of the right and left segments of the button 44 cause the motor 30 to operate in turning the selected vehicle toward the right and the left.

It will be appreciated that pairs of segments of the button 44 may be simultaneously depressed. For example, the top and left portions of the button 44 may be simultaneously depressed to obtain a simultaneous movement of the vehicle 12 forwardly and to the left. However, a simultaneous actuation of the top and bottom segments of the button 44 will not have any effect since they represent contradictory commands. This is also true of a simultaneous depression of the left and right segments of the button 44.

Figure 2:
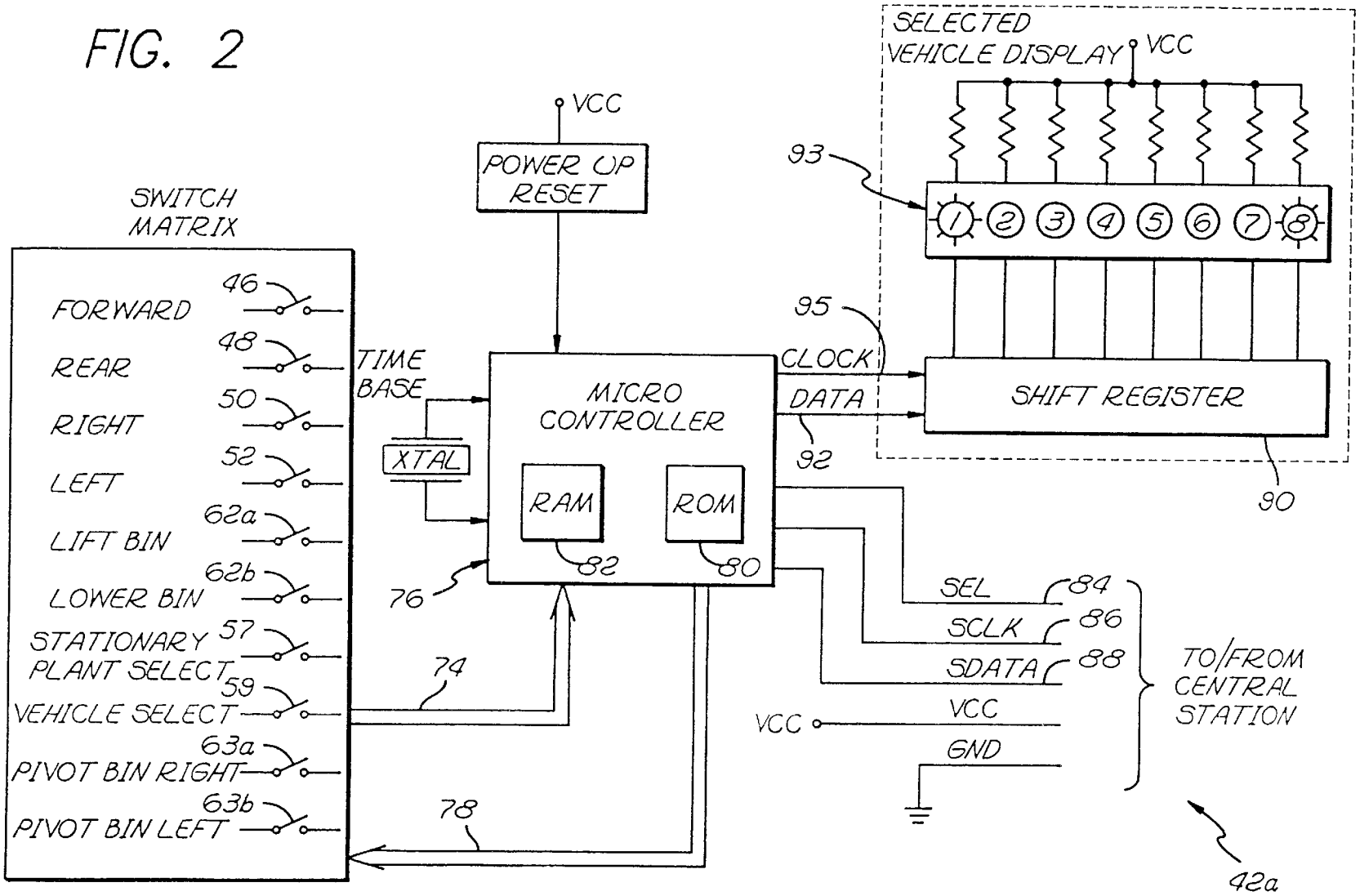
FIG. 2 is a schematic diagram, primarily in block form, of the different features in a pad included in the system shown in FIG. 1.

Each of the pads 42*a*, 44*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 within the particular period of time in such pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A button 58 is provided in each of the pads 42*a*, 42*b*, 42*c* and 42*d* to select one of the vehicles 12, 14, 16 and 17. The individual one of the vehicles 12, 14, 16 and 17 selected at any instant by each of the pads 42*a*, 42*b*, 42*c* and 42*d* is dependent upon the number of times that the button is depressed in that pad within a particular period of time. For example, one (1) depression of the button 58 may cause the dump truck 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the pad 12 to count the number of depressions of the button 58 within the particular period of time. This count is converted into a plurality of binary signals indicating the count. The count is provided at the end of the particular period of time.

Buttons 60*a* and 60*b* are also included on each of the pads 42*a*, 42*b*, 42*c* and 42. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck 12 has been selected by the proper number of depressions of the switch 58, the closure of the switch 62*b* causes the selective one of the bin 18 in the dump truck 12, the platform 20 in the fork lift 14 and the bin 22 in the skip loader 16 and the bin 23 in the skip loader 17 to move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to sco-op elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the selected one of the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

A central station generally indicated at 64 in FIG. 1 processes the signals from the individual ones of the pads 42*a*, 42*b*, 42*c* and 42*d* and sends the processed signals to the vehicles 12, 14, 16 and 17 when the button 58 on an individual one of the pads has been depressed to indicate that the information from the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pad 42*a* in FIG. 2 receives the interrogating signals from the central station 64 through a line 84. These interrogating signals are not synchronized by clock signals on a line 86. Each of the interrogating signals intended for the pad 42*a* may be identified by an address individual to such pad. When the pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the pad 42*a* selects one of the vehicles 12, 14, 16 and 17 in accordance with the number of closings of the switch 59. As the user of the pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED) generally indicated at 93. The shifting of the indication in the shift register 90 may be synchronized with a clock signal on a line 95. Thus, the illuminated one of the light emitting diodes 92 at each instant indicates at that instant the individual one of the vehicles 42*a*, 42*b*, 42*c* and 42*d* that the pad 42*a* has selected at such instant.

Figure 3:
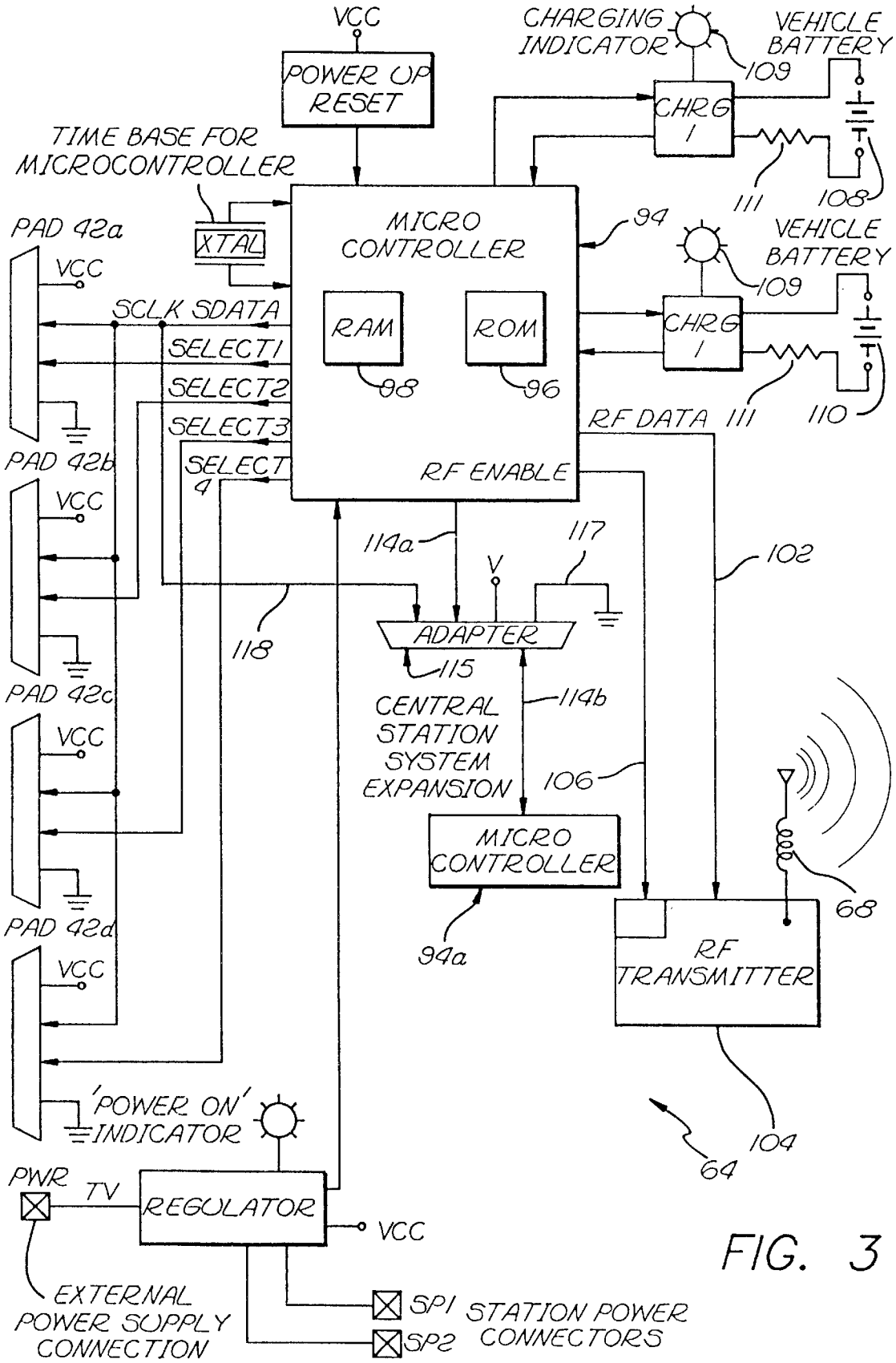
FIG. 3 is a schematic diagram, primarily in block form, of the different features included in a central station included in the system shown in FIG. 1.

The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the pad 42*a* can provide an address indicating the pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16 and 17 in FIG. 1 and between each individual one of such pads and a selective one of the stationary accessories 34 and 38. The random access memory 98 also stores the status of the operation of the switches 46, 48, 50 and 52 for each pad and the operation of the switches 57, 59, 62*a*, 62*b*, 63*a* and 63*b* for each pad.

When the central station 64 receives from the pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the pad 42*a* is introduced through a line 102 in FIG. 3 to a radio frequency transmitter 104 in the central station 64. The radio frequency transmitter 104 is enabled by a signal passing through a line 106 from the microcontroller 94. This enabling signal is produced by the microcontroller 94 when the microcontroller confirms that it has received signals from the pad 42*a* as a result of the interrogating signals from the central station 64.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14 and 16 being energized at each instant by the individual ones of the pads 42*a*, 42*b*, 42*a* and 42*d*. Because of this, the central station 64 is able to prevent the interrogated one of the pads 42*a*, 42*b*, 42*c* and 42*d* from selecting one of the energized vehicles. Thus, for example, if the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected.

Furthermore, in the example above where the pad 42*a* has previously selected the vehicle 14, the microcomputer 94 in the central station 64 will cause the vehicle 14 to be released when the pad 42*a* selects any of the vehicles 12, 16 and 17. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged.

Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in a second central station corresponding to the central station 64 may be connected by cables 114*a* and 114*b* to an adaptor generally indicated at 115.

One end of the cable 114*a* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcomputer 94*a* so that the central station including the microcomputer 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system.

The expanded system including the microcomputers 94 and 94*a* may be adapted so that the address and data signals generated in the microcomputer 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 4:
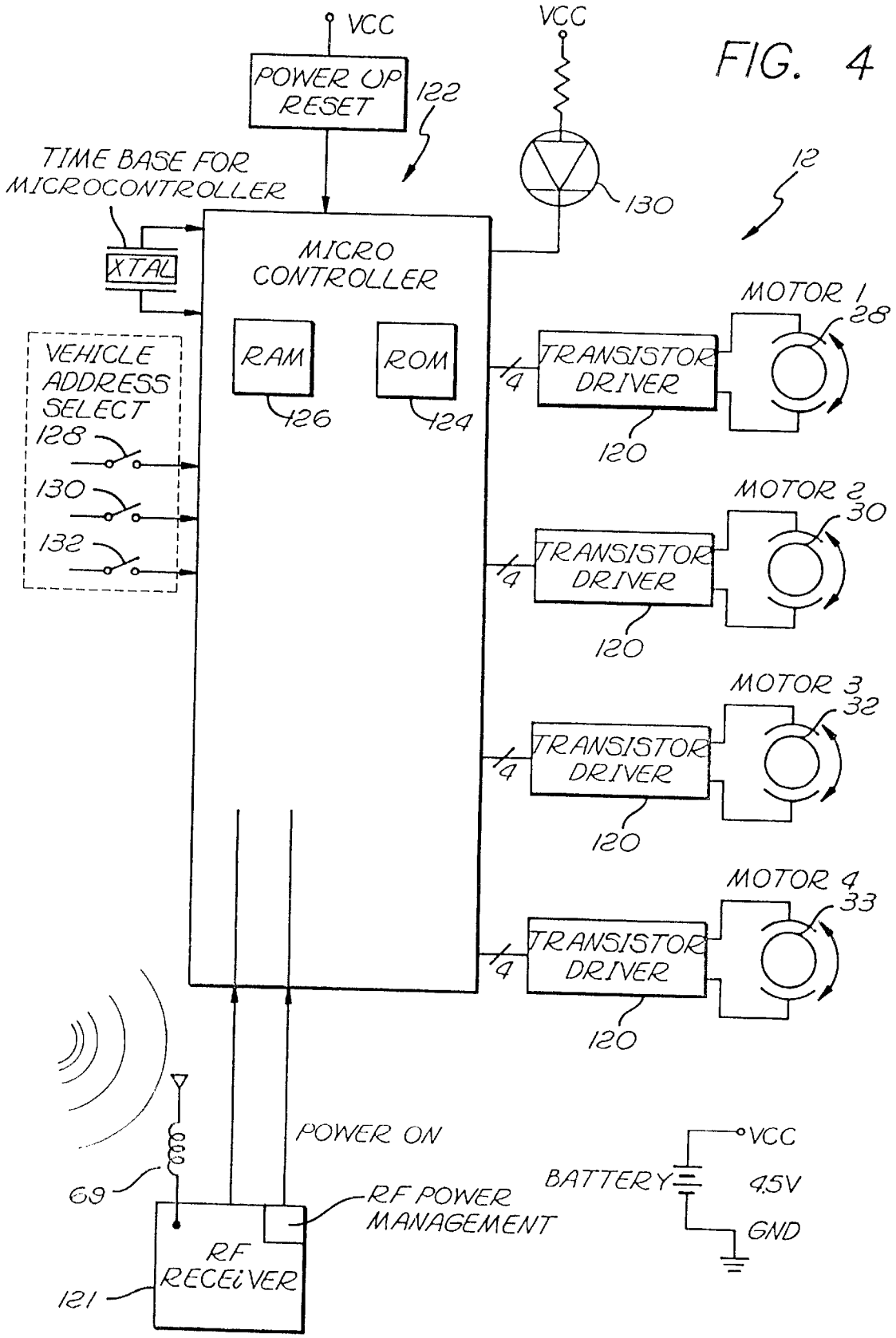
FIG. 4 is a schematic diagram, primarily in block form, of the different features in a vehicle included in the system shown in FIG. 1.

The vehicle 12 is shown in additional detail in FIG. 4. Substantially identical arrangements may be provided for the vehicles 14, 16 and 17. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32 and 33 receives signals from an individual one of transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 130. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously indicated, the user of one of the pads such as the pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the station 64 to the vehicle 12. As long as the buttons on the pad 42*a* are depressed within a particular period of time to command the vehicle 12 to perform individual functions, the microprocessor 94 in the central station 64 will direct the address of the vehicle 12 to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42 again depresses the button 58 the correct number of times within the particular period of time to select the vehicle 12.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcomputer 122 in the vehicle equals the period of time in the read only memory 124, the microcontroller 122 issues a command to extinguish the light emitting diode 130. This indicates to the different users of the system, including the user previously controlling the operation of the vehicle 121 that the vehicle is available to be selected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 130 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method of this invention are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a co-ordinated basis.

There are also other significant advantages in the system and method of this invention. Two or more systems can be combined to increase the number of pads 142 controlling the operation of the vehicles 12, 14 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method of this invention are also advantageous in the provision of the pads and the provision of the button and switches in the pads. As will be appreciated, the pads are able to select vehicles and/or stationary accessories through the operation of a minimal number of buttons and to provide for the operation of a considerable number of different functions in the vehicles with a minimal number of buttons. In co-operation with the central station, the pads are able to communicate the selection of vehicles to the central station without indicating to the station, other than on a time shared basis, the identities of the vehicles being selected. After selecting a vehicle, each pad does not thereafter have to indicate the identity of the vehicle as long as the pad operates the vehicle through the central station within a particular period of time from the last operation of the vehicle by the pad through the central station.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

What is claimed is:

1. In a method at a central station for controlling the operation of any individual one of a plurality of vehicles in accordance with the selection of such vehicle by any individual one of pads in a plurality and in accordance with the operation in such individual one of the pads of controls to obtain the performance of any one of a plurality of different functions in such individual one of the vehicles, the steps of:

interrogating the pads to determine from each of such pads the selection of any individual one of the vehicles and the functions to be performed in such individual one of the vehicles, receiving from each of the interrogated pads signals indicating the individual one of the vehicles selected by such interrogated one of the pads and indicating the individual ones of the functions to be performed in such selected one of the vehicles, providing first signals indicating the address of each selected one of the vehicles and second signals indicating the individual ones of the functions to be performed in such selected one of the vehicles, and transmitting packets with the first and second signals to the vehicles to obtain the reception by each individual one of the vehicles of the packets of signals in which the address represented by the first signals corresponds to the address of such individual one of the vehicles.

2. In a method as set forth in claim 1, steps of:

providing a memory of the selection of each individual one of the vehicles by the individual one of the pads, and thereafter providing the signals indicating in the memory the address of the individual one of the vehicles selected by each individual one of the pads when the central station receives from such individual one of the pads the signals indicating the functions to be performed by such individual one of the vehicles without receiving the signals indicating the address of such individual one of the vehicles, and transmitting the packets with the first and second pluralities of signals to the vehicles.

3. In a method as set forth in claim 1, the steps of:

releasing each individual one of the vehicles to provide for the selection of such individual one of the vehicles by any one of the pads in the plurality, including the individual one of the pads, when the central station fails to receive for a particular period of time signals from such individual one of the pads upon the interrogation of such individual one of the pads by the central station.

4. In a method as set forth in claim 1, the steps of:

there being a plurality of stationary accessories for selection of any one of the accessories by each individual one of the pads, receiving from each individual one of the pads signals indicating the selection of any individual one of the stationary accessories by such individual one of the pads, and transmitting signals to the individual one of the stationary accessories in accordance with the signals from the individual one of the pads to obtain the operation of such individual one of the stationary accessories.

5. In a method as set forth in claim 4 wherein the central station interrogates each individual one of the pads through wires connected between the central station and the pad and receives signals from the pads through wires connected between the central station and the pads and wherein the central station transmits the signals to individual ones of the stationary accessories through wires connected between the central station and the individual ones of the stationary accessories and wherein the central station transmits the signals to individual ones of the vehicles in the plurality on a wireless basis.

6. In a method as set forth in claim 3, the steps of:

there being a plurality of stationary accessories for selection of any individual one of the stationary accessories by each individual one of the pads, receiving from each individual one of the pads signals indicating the selection of and individual one of the stationary accessories by such individual one of the pads, and transmitting signals to each individual one of the stationary accessories in accordance with the signals from any individual one of the pads to obtain the operation of such individual one of the stationary accessories and wherein the central station interrogates each individual one of the pads through wires connected between the central station and the individual one of the pads and receives signals from the individual one of the pads through wires connected between the central station and the individual one of the pads and wherein the central station transmits the signals to the stationary accessories through wires connected between the central station and the the stationary accessories and wherein the central station transmits the signals to the the vehicles in the plurality on a wireless basis.

7. In a method in an individual one of a plurality of pads co-operating with a central station to select any individual one of a plurality of vehicles and to obtain the operation of individual ones of a plurality of functions in the selected one of the vehicles, providing in the individual one of the pads a plurality of controls operable to provide for the selection of any individual one of the vehicles and to provide for the performance of any individual ones of the functions in such individual one of the vehicles, receiving in the individual one of the pads from the central station signals interrogating the individual one of the pads to determine the pattern of operation of the controls in such individual one of the pads, and sending from the individual one of the pads to the central station a plurality of signals, upon the reception of the interrogating signals by the individual one of the pads from the central station, in a pattern to indicate the selection of any individual one of the vehicles and the performance of the individual ones of the functions in such individual one of the vehicles.

8. In a method as set forth in claim 7, there being a plurality of stationary accessories, providing in the individual one of the pads at least one additional control operable to obtain the selection of any individual one of the accessories, and sending from the individual one of the pads to the central station signals indicating the operation of the least one additional control upon the reception at the individual one of the pads of the interrogation from the central station.

9. In a method of selectively controlling the operation of toy vehicles in a plurality, the steps of:

providing a plurality of pads each having a plurality of controls individually operable to select any one of the vehicles in the plurality and to select functions to be performed in the selected one of the vehicles in the plurality, operating controls in the different pads to obtain the selection by each pad of any individual one of the vehicles and to select individual ones of the functions to be performed in the individual one of the vehicles, providing a central station, providing for an interrogation of the pads by the central station to determine the selection by each pad of any individual one of the vehicles, providing for the transmission by each individual one of the pads to the central station, upon the interrogation of such individual one of the pads by the central station, of signals indicating the individual one of the vehicles selected by such interrogated one of the pads and signals indicating the individual ones of the functions to be performed by such individual one of the vehicles, providing in the central station, for each individual one of the vehicles, an address indicating such individual one of the vehicles when such vehicle is selected by the interrogated one of the pads, and providing for the transmission by the central station to the vehicles of signals indicating the address of the individual one of the vehicles selected by the interrogated one of the pads and indicating the functions to be performed in such individual one of the vehicles.

10. In a method as set forth in claim 9, the steps of:

receiving at each of the vehicles the signals transmitted from the central station, and decoding at each individual one of the vehicles the signals indicating the functions to be performed by such individual one of the vehicles when the received signals indicate the address of such individual one of the vehicles.

11. In a method as set forth in claim 9, the steps of:

providing in packets at the central station the signals indicating the address of the individual one of the vehicles addressed by each individual one of the pads and the functions to be performed in such individual one of the vehicles, and responding at each individual one of the vehicles to the packets of signals indicating the address of such individual one of the vehicles to perform in such individual one of the vehicles the functions indicated by the signals in such packets.

12. In a method as set forth in claim 9, the steps of:

providing a plurality of stationary accessories each operative to perform an individual function, operating a particular one of the controls in each individual one of the pads to select any individual one of the stationary accessories, providing for the transmission by each individual one of the pads to the central station, upon the interrogation of such individual one of the pads by the central station, of signals indicating the operation of the control in such individual one of the pads to select any individual one of the stationary accessories, and providing for the transmission by the central station to the stationary accessories of signals for obtaining the operation of each individual one of the stationary accessories when such individual one of the stationary accessories is selected by any individual one of the pads and when such individual one of the pads is interrogated by the central station.

13. In a method as set forth in claim 12, including the step of:

providing for the transmission of signals between the pads and the central station through wires and providing for the transmission of signals from the central station to the stationary accessories through wires and providing for the transmission of signals from the central station to the vehicles on a wireless basis.

14. In a method as set forth in claim 9, the steps of:

providing in packets at the central station the signals indicating the address of each individual one of the vehicles and the functions to be performed in such individual one of the vehicles, decoding at each of the vehicles the packets of signals indicating the functions to be performed by such individual one of the vehicles when the received signals indicate the address of such individual one of the vehicles, performing in the individual one of the vehicles the functions indicated in the decoded packets, providing a plurality of stationary accessories each operative to perform an individual function, operating a particular one of the controls in each of the pads to select any individual one of the stationary accessories, providing for the transmission by each individual one of the pads, upon the interrogation of such individual one of the pads by the central station, of signals indicating the operation of the control in such individual one of the pads to select any individual one of the stationary accessories, providing for the transmission by the central station to the stationary accessories of signals for obtaining the operation of each individual one of the stationary accessories when such individual one of the stationary accessories is selected by any individual one of the pads and when such individual one of the pads is interrogated by the central station, and providing for the transmission of signals between the pads and the central station through wires and providing for the transmission of signals from the central station to the stationary accessories through wires and providing for the transmission of signals from the central station to the vehicles on a wireless basis.

15. In a method at a central station for controlling the operation of each individual one of a plurality of vehicles in accordance with the selection of such vehicle by any individual one of a plurality of pads and in accordance with the operation in such individual one of the pads of controls to obtain the performance of individual ones of a plurality of different functions in such individual one of the vehicles, the steps of:

receiving at the central station from each individual one of the pads first signals indicating the selection of any individual one of the vehicles and second signals indicating the individual ones of the different functions to be performed in such individual one of the vehicles, producing at the central station first patterns of signals indicating the addresses of the individual ones of the vehicles selected by any individual one of the pads in accordance with the receipt of the first signals from the individual one of the pads, producing at the central station for each individual one of the vehicles a second pattern of signals indicating the individual ones of the different functions to be performed in such individual one of the vehicles, combining at the central station the first and second patterns of signals for each individual one of the vehicles to produce packets of such first and second signals, transmitting at the central station to the vehicles the packets of the signals in the first and second patterns for each of the vehicles to provide for the reception of the packets in each individual one of the vehicles in accordance with the addresses represented by the patterns of the first signals in the packets and to provide for the performance of the individual ones of the functions in the individual one of the vehicles in accordance with the patterns of the second signals in such packets, and maintaining at the central station the selection of each individual one of the vehicles by any individual one of the pads as long as the central station continues to receive from such individual one of the pads second signals, within a particular period of time after the previous reception of such second signals, indicating the different functions to be performed in such individual one of the vehicles.

16. In a method at a central station for controlling the operation of each individual one of a plurality of vehicles in accordance with the selection of such vehicle by any individual one of a plurality of pads and in accordance with the operation in such individual one of the pads of controls to obtain the performance of individual ones of a plurality of different functions in such individual one of the vehicles, the steps of:

receiving at the central station from each individual one of the pads in the plurality first signals indicating the selection of any individual one of the vehicles and second signals indicating the different functions to be performed in such individual one of the vehicles, producing at the central station first patterns of signals indicating the address of the individual one of the vehicles selected by any individual one of the pads in accordance with the receipt of the first signals from the individual one of the pads, producing at the central station for each individual one of the vehicles a second pattern of signals indicating the individual ones of the different functions to be performed in such individual one of the vehicles, combining at the central station the first and second patterns of signals for each individual one of the vehicles to produce packets of such first and second signals, and transmitting at the central station to the vehicles the packets of the signals in the first and second patterns for each of the vehicles to provide for the reception of the packets in each individual one of the vehicles in accordance with the addresses represented by the patterns of the first signals in the packets and to provide for the performance of the individual ones of the functions in the individual one of the vehicles in accordance with the patterns of the second signals in such packets, the central station constituting a first central station and the pads in the plurality constituting a first plurality and the vehicles in the plurality constituting a first plurality, providing a second central station which operates in the same manner as the first central station and which responds to the signals from each individual one of the pads in a second plurality to control the selection and operation of any individual one of the vehicles in a second plurality, and making the operation of the second central station a slave to the operation of the first central station.

17. In a method at a central station for controlling the operation of each individual one of a plurality of vehicles in accordance with the selection of such vehicle by any individual one of a plurality of pads and in accordance with the operation in such individual one of the pads of controls to obtain the performance of individual ones of a plurality of different functions in such individual one of the vehicles, the steps of:

receiving at the central station from each individual one of the pads first signals indicating the selection of any individual one of the vehicles and second signals indicating the different functions to be performed in such individual one of the vehicles, producing at the central station first patterns of signals indicating the address of any individual one of the vehicles selected by the individual one of the pads in accordance with the receipt of the first signals from the individual one of the pads, producing at the central station for each individual one of the vehicles a second pattern of signals indicating the individual ones of the different functions to be performed in such individual one of the vehicles, combining at the central station the first and second patterns of signals for each individual one of the vehicles to produce packets of such first and second signals, and transmitting at the central station to the vehicles the packets of the signals in the first and second patterns for each of the vehicles in the plurality to provide for the reception of the packets in the individual one of the vehicles in accordance with the addresses represented by the patterns of the first signals in the packets and to provide for the performance of the individual ones of the functions in the individual one of the vehicles in accordance with the patterns of the second signals in such packets, providing a memory at the central station, storing in the memory at the central station the selection of each individual one of the vehicles by any individual one of the pads, eliminating from the memory at the central station the selection of each individual one of the vehicles by any individual one of the pads when the central station fails to receive from the individual one of the pads for a particular period of time any signals indicating any functions to be performed in such individual one of the vehicles, maintaining at the central station the selection of each individual one of the vehicles by any individual one of the pads as long as the central station continues to receive from the individual one of the pads second signals, within a particular period of time after the previous reception of such second signals, indicating the different functions to be performed in such individual one of the vehicles, the central station constituting a first central station and the pads in the plurality constituting a first plurality and the vehicles in the plurality constituting a first plurality, providing a second central station which operates in the same manner as the first central station and which responds to the signals from each individual one of the pads in a second plurality to control the selection and operation of any one of the vehicles in a second plurality, and making the operation of the second central station a slave to the operation of the first central station.

18. In a method at a central station for controlling the operation of a plurality of vehicles in accordance with the addressing of the vehicles by pads in a plurality and in accordance with the operation in the pads of controls to obtain the performance of functions in the vehicles, the steps of:

interrogating at the central station the pads to determine from the pads the addressing of any individual ones of the vehicles and the functions to be performed in the addressed vehicles, receiving at the central station from the pads indications of the individual ones of the vehicles addressed by the pads and indications of the functions to be performed in the addressed vehicles, providing at the central station first signals indicating the address of each individual one of the addressed vehicles and second signals indicating the functions to be performed in the addressed vehicle, providing at the central station packets with the first and second signals, after the addressing of the individual ones of the vehicles by the pads, even when the pads provide only the second indications for the addressed vehicles, and transmitting at the central station the packets with the first and second signals to all of the vehicles to provide for a processing by the individual ones of the vehicles of the packets of signals in which the addresses represented by the first signals for the individual ones of the vehicles correspond to the addresses of the individual ones of the vehicles.

19. In a method at a central station for controlling the operation of a plurality of vehicles in accordance with the addressing of the vehicles by a plurality of pads and in accordance with the operation in the pads of controls to obtain the performance of functions in the vehicles, the steps of:

receiving at the central station from each individual one of the pads first signals indicating the addressing of any individual ones of the vehicles and second signals indicating the functions to be performed in the addressed vehicle, producing at the central station a first pattern of signals indicating the address of any individual one of the vehicles addressed by each individual one of the pads in accordance with the receipt of the first signals from the individual one of the pads, producing at the central station for each individual one of the vehicles a second pattern of signals indicating the functions to be performed in the vehicle, combining at the central station the first and second patterns of signals for each individual one of the vehicles to produce packets of the signals, and transmitting at the central station the packets of the signals in the first and second patterns for each individual one of the vehicles to all of the vehicles to provide for the reception of the packets in the individual one of the vehicles in accordance with the addresses represented by the first patterns of the signals in the packets and to obtain the performance of the functions in the individual one of the vehicles in accordance with the second patterns of the signals in the packets, providing a memory at the central station, storing in the memory at the central station the addressing of each individual one of the vehicles by the individual one of the pads, and eliminating from the memory at the central station the addressing of each individual one of the vehicles by the individual one of the pads when the central station fails to receive the second pattern of signals from the individual one of the pads for a particular period of time for the individual one of the vehicles, and maintaining at the central station the addressing of each individual one of the vehicles by the individual one of the pads as long as the central station continues to receive the second pattern of signals from the individual one of the pads within a particular period of time after the previous reception by the central station of the second pattern of signals from the individual one of the pads.

20. A method of controlling the operation of toy vehicles, including the steps of:

providing a plurality of the toy vehicles each having an address different from the addresses of the other vehicles, providing a plurality of pads each providing addresses for addressing any individual one of the vehicles, providing for an addressing by each of the pads of any individual one of the vehicles, providing for an operation by each of the pads of the individual one of the vehicles after the addressing of the individual one of the vehicle by the pad, and providing for a release of each individual one of the vehicle by the pad controlling the operation of the individual one of the vehicles when the pad fails to operate the individual one of the vehicles for a particular period of time, and providing for an addressing of each individual one of the vehicles by any one of the pads, including the pad controlling the operation of the individual one of the vehicles, after the release of the individual one of the vehicles as a result of the failure of the pad controlling the operation of the individual one of the vehicles to operate the individual one of the vehicles for the particular period of time.

21. A method as set forth in claim 20, including the steps of:

providing on each of the pads a plurality of visual indications each identifying an individual one of the vehicles, and providing for an energizing on each of the pads of the visual indication identifying the individual one of the vehicles addressed by the pad.

22. A method as set forth in claim 20, including the steps of:

providing on each individual one of the vehicles a visual indication identifying the vehicle, and energizing the visual indication on each individual one of the vehicles when the individual one of the vehicles is addressed by any one of the pads.

23. A method as set forth in claim 20, including the steps of:

providing a control on each of the pads with a plurality of sequentially operable positions each identifying an individual one of the vehicles, and sequentially operating the control in each of the pads to the control position identifying any one of the vehicles to be addressed by the pad.

24. A method as set forth in claim 23, including the steps of:

providing for the skipping, during the sequential operation of the control in each of the pads, of the positions identifying vehicles addressed by the other pads.

25. A method as set forth in claim 24, including the steps of:

providing on each of the pads a plurality of visual indications each identifying an individual one of the vehicles, providing for an energizing on each of the pads of the visual indication identifying the individual one of the vehicles addressed by the pad, providing on each individual one of the vehicles a visual indication identifying the vehicle, and energizing the visual indication on each individual one of the vehicles when the vehicle is addressed by any one of the pads.

26. A method of controlling the operation of toy vehicles, including the steps of:

providing a plurality of the toy vehicles each having an address different from the addresses of the other toy vehicles, providing a plurality of pads each providing addresses for any one of the vehicles and each having controls for obtaining an operation of any individual one of the vehicles in accordance with the operation of the controls after the addressing of the individual one of the vehicles by the pad, initially providing for an addressing by each of the pads of any individual one of the vehicles, and thereafter providing for the operation of each individual one of the vehicles in accordance with the operation of the controls in the pad initially addressing the individual one of the vehicles without the addressing of the individual one of the vehicles by the pad.

27. A method as set forth in claim 26, including the steps of:

providing on each of the pads a plurality of visual indications identifying each individual one of the vehicles, and providing for an energizing on each of the pads of the visual indication identifying the individual one of the vehicles addressed by the pad.

28. A method as set forth in claim 26, including the steps of:

providing on each individual one of the vehicles a visual indication identifying the vehicle, and energizing the visual indication on each individual one of the vehicles when the vehicle is addressed by any one of the pads.

29. A method as set forth in claim 26, including the steps of:

providing an additional control on each of the pads with a plurality of sequentially operable positions each identifying an individual one of the vehicles, and sequentially operating the additional control in each of the pads to the control position identifying any individual one of the vehicles to be addressed by the pad.

30. A method as set forth in claim 29, including the steps of:

providing for the skipping, during the sequential operation of the control in each of the pads, of the control positions identifying any of the vehicles addressed by the other pads.

31. A method as set forth in claim 30, including the steps of:

providing on each of the pads a plurality of visual indications each identifying an individual one of the vehicles, providing for an energizing on each of the pads of the visual indication identifying any one of the vehicles addressed by the pad, providing on each individual one of the vehicles a visual indication identifying the vehicle, and energizing the visual indication on each individual one of the vehicles when the vehicle is addressed by any one of the pads.

32. A method of controlling the operation of toy vehicles, including the steps of:

providing a plurality of toy vehicles each having an address different from the addresses of the other vehicles, providing a plurality of pads each having a control operable to provide for the addressing of any one of the vehicles and each having additional controls providing for the operation of the addressed vehicle, providing a central station for communicating the addresses provided by the operation of the controls in the pads, providing for an addressing by the central station of each individual one of the vehicles in accordance with the operation of the controls in any one of the pads, providing in the central station for an operation of each individual one of the vehicles in accordance with the operation of the additional controls in the pad controlling the operation of the vehicle after the addressing of the vehicle by the central station, providing in the central station for a release of each individual one of the vehicles by the pad controlling the operation of the vehicle when the pad fails for a particular period of time to provide for the operation of the vehicle, and providing in the central station for an addressing of each individual one of the vehicles by the operation of the control in any one of the pads, including the pad controlling the operation of the individual one of the vehicles, after the release of the vehicle as a result of the failure of the pad controlling the operation of the vehicle to operate the vehicle for the particular period of time.

33. A method as set forth in claim 32, including the steps of:

providing on each of the pads a plurality of visual indications each identifying an individual one of the vehicles, and providing for an energizing on each of the pads of the visual indication identifying the individual one of the vehicles addressed by the pad.

34. A method as set forth in claim 32, including the steps of:

providing on each individual one of the vehicles a visual indication identifying the vehicle, and energizing the visual indication on each individual one of the vehicles when the vehicle is addressed by any one of the pads.

35. A method as set forth in claim 32, including the steps of:

providing the control on each of the pads with a plurality of sequentially operable positions each identifying an individual one of the vehicles, and sequentially operating the control in each of the pads to the control position identifying the individual one of the vehicles to be addressed by the pad.

36. A method as set forth in claim 35, including the steps of:

providing for the skipping, during the sequential operation of the control in each of the pads, of the positions identifying individual ones of the vehicles selected by the other pads.

37. A method as set forth in claim 36, including the steps of:

providing on each of the pads a plurality of visual indications each identifying an individual one of the vehicles, providing for an energizing on each of the pads of the visual indication identifying the individual one of the vehicles addressed by the pad, providing on each of the vehicles a visual indication identifying the vehicle, and energizing the visual indication on each of the vehicles when the vehicle is addressed by any one of the pads.

38. A method of controlling the operation of toy vehicles, including the steps of:

providing a plurality of the toy vehicles each having an address different from the addresses of the other vehicles, providing a plurality of pads each having a first control operable to provide for the addressing of any individual one of the vehicles and each having second controls for obtaining an operation of the individual one of the vehicles in accordance with the operation of the second controls in the pad after the addressing of the individual one of the vehicles by the operation of the first control in the pad, providing a central station for communicating the addresses provided by the operation of the first controls in the pads, providing for an addressing by the central station of each individual one of the vehicles in accordance with the operation of the first control in any one of the pads, thereafter providing in the central station for an addressing of each individual one of the vehicles by the operation of the second controls, without the operation of the first control, in the pad controlling the operation of the vehicle.

39. A method as set forth in claim 38, including the steps of:

providing on each of the pads a plurality of visual indications each identifying an individual one of the vehicles, and providing for an energizing on each of the pads of the visual indication identifying the individual one of the vehicles addressed by the pad.

40. A method as set forth in claim 38, including the steps of:

providing on each of the vehicles a visual indication identifying the vehicle, and energizing the visual indication on each of the vehicles when the vehicle is addressed by any one of the pads.

41. A method as set forth in claim 38, including the steps of:

providing a control on each of the pads with a plurality of sequentially operable positions each identifying an individual one of the vehicles, and sequentially operating the control in each of the pads to the control position identifying the individual one of the vehicles to be addressed by the pad.

42. A method as set forth in claim 41, including the steps of:

providing for the skipping, during the sequential operation of the control in each of the pads, of the control positions identifying the vehicles selected by the other pads.

43. A method as set forth in claim 41, including the steps of:

providing on each of the pads a plurality of visual indications each identifying an individual one of the vehicles, providing for an energizing on each of the pads of the visual indication identifying the individual one of the vehicles addressed by the pad, providing on each of the vehicles a visual indication identifying the vehicle, and energizing the visual indication on each of the vehicles when the vehicle is addressed by any one of the pads.

44. A method of controlling the operation of toy vehicles, including the steps of:

providing a plurality of first toy vehicles each having an address different from the addresses of the others of the first toy vehicles, providing first pads each having a first control operable to provide for the addressing of any one of the vehicles and each having second controls for obtaining an operation of the addressed one of the vehicles in accordance with the operation of the second controls in the pad after the addressing of the vehicle by the operation of the first control in the pad, providing a first central station for communicating the addresses provided for by the first control in each of the first pads for the vehicles and for communicating commands represented for the vehicles by the operation of the second controls in the first pad, providing for the operations of each individual one of the first vehicles in accordance with the commands communicated from the first central station, providing a plurality of second vehicles, a plurality of second pads and a second central station respectively corresponding to the first vehicles, the first pads and the first central station, and providing for the operation of the second central station as a slave to the first central station.

45. A method as set forth in claim 44, including the steps of:

providing in each of the first and second pads a plurality of visual indications each identifying any one of the vehicles capable of being addressed by the operation of the first control on the pad, and providing for an energizing on each of the first and second pads of the visual indication of any one the vehicles addressed by the operation of the first control on the pad.

46. A method as set forth in claim 44, including the steps of:

providing on each of the first and second vehicles a visual indication identifying the vehicle, and energizing the visual indication on each individual one of the first and second vehicles when the vehicle is addressed by any one of the pads.

47. A method as set forth in claim 44, including the steps of:

providing the first control on each of the first and second pads with a plurality of sequentially operable positions each identifying an individual one of the vehicles capable of being addressed by the operation of the first control in the pad, and sequentially operating the first control in each of the first and second pads to any one of the control positions providing for an addressing of the vehicle identified by the one of the control positions.

48. A method as set forth in claim 47, including the step of:

providing for the skipping, during the sequential operation of the control in each of the first and second pads, of the control positions identifying the vehicles addressed by the other ones of the first and second pads.

49. A method as set forth in claim 48, including the steps of:

providing in each of the first and second pads a plurality of visual indications each identifying an individual one of the vehicles addressed by the pad, providing for an energizing on each of the first and second pads of the visual indication of the individual one of the vehicles addressed by the operation of the first control in the pad, providing on each individual one of the first and second vehicles a visual indication identifying the vehicle, and energizing the visual indication on each individual one of the first and second vehicles when the vehicle is addressed by any one of the pads.

* * * * *

UNITED STATES PATENT AND TRADEMARK OFFICE

CERTIFICATE OF CORRECTION

PATENT NO. : 6,238,265 B1
DATED : May 29, 2001
INVENTOR(S) : John J. Crane et al.

It is certified that error appears in the above-identified patent and that said Letters Patent is hereby corrected as shown below:

Column 5,
Line 10, delete “sco-op” and insert -- scoop --.

Column 11,
Line 50, after “claim 1,” and insert -- the --.

Column 12,
Line 24, after “signals to” insert -- the --.
Lines 51 and 53, delete the second occurrence of “the”.

Column 17,
Line 22, delete “pads in”.
Line 22, after “a plurality” insert -- of pads --.

Column 22,
Line 58, delete “a plurality of second vehicles, a plurality of”, and insert -- second vehicles, --.
Lines 66-67, delete “a plurality of”.

Column 23,
Line 9, after “on each” insert -- individual one --.
Line 22, delete “any one” and insert -- any individual one --.
Lines 22 and 24, delete “control”.
Line 24, delete “the one” and insert -- the individual one --.

Column 24,
Line 5, delete “control”.

Signed and Sealed this

Twenty-second Day of February, 2005

JON W. DUDAS
*Director of the United States Patent and Trademark Office*